US011877706B2

(12) United States Patent
Gabriel

(10) Patent No.: US 11,877,706 B2
(45) Date of Patent: Jan. 23, 2024

(54) COLLAPSIBLE PORTABLE CLEANING SYSTEM AND METHOD OF USE THEREOF

(71) Applicant: Wesly Gabriel, Charlotte, NC (US)

(72) Inventor: Wesly Gabriel, Charlotte, NC (US)

( * ) Notice: Subject to any disclaimer, the term of this patent is extended or adjusted under 35 U.S.C. 154(b) by 0 days.

(21) Appl. No.: 17/875,841

(22) Filed: Jul. 28, 2022

(65) Prior Publication Data

US 2023/0248185 A1 Aug. 10, 2023

Related U.S. Application Data

(60) Provisional application No. 63/307,752, filed on Feb. 8, 2022.

(51) Int. Cl.
*A47K 3/32* (2006.01)
*A47K 3/06* (2006.01)
*A47K 3/40* (2006.01)

(52) U.S. Cl.
CPC ..... *A47K 3/325* (2013.01); *A47K 3/06* (2013.01); *A47K 3/40* (2013.01)

(58) Field of Classification Search
CPC ..... A47K 3/325; A47K 3/06; A47K 4/40
USPC ..... 4/599
See application file for complete search history.

(56) References Cited

U.S. PATENT DOCUMENTS 1,450,218 A * 4/1923 Nenoff ..... A47K 3/325 4/599
3,657,746 A * 4/1972 Downey ..... A47K 3/325 4/603
4,023,220 A * 5/1977 Younker ..... A47K 3/06 4/588
4,909,268 A * 3/1990 Maggio ..... E04H 1/1205 52/79.5
4,974,265 A * 12/1990 Maggio ..... A47K 3/325 135/901
5,216,763 A * 6/1993 Grenier ..... A47K 3/32 4/601
6,463,599 B1 * 10/2002 Perthu ..... A47K 3/325 4/603
2013/0340159 A1 * 12/2013 Barrett ..... A47K 3/325 4/599

* cited by examiner

*Primary Examiner* — Huyen D Le
(74) *Attorney, Agent, or Firm* — Brennan, Manna & Diamond, LLC

(57) ABSTRACT

The present invention relates to a collapsible portable shower or personal hygiene system. The system is in the form of a collapsible enclosure formed by two interlocking pieces including a collapsible tapered top piece and a collapsible tapered bottom piece. Both the top piece and the bottom piece have foldable panels for collapsing and extending the device. The top piece further has a protrusion at the bottom, and the bottom piece has a groove along the top surface for creating a leakproof enclosure. Finally, the top piece further comprises handles and hanging holes or openings, and the bottom piece comprises a drain hole for draining water from the device upon completion of the bathing process.

20 Claims, 6 Drawing Sheets

COLLAPSIBLE PORTABLE CLEANING SYSTEM AND METHOD OF USE THEREOF

CROSS-REFERENCE TO RELATED APPLICATION

The present application claims priority to, and the benefit of, U.S. Provisional Application No. 63/307,752, which was filed on Feb. 8, 2022, and is incorporated herein by reference in its entirety.

FIELD OF THE INVENTION

The present invention relates generally to the field of portable cleaning systems. More specifically, the present invention relates to a collapsible and portable shower system configured to be used by frequent travelers, campers and others that find themselves without the convenience of a traditional bathing area nearby. The shower system is in the form of a bucket and manufactured from silicone and plastic and has two detachable portions which are removably interlocked with one another. The bucket can hold around four gallons of water and has a drain hole for draining water. A user can stand or kneel inside the shower system for a quick cleanse. After use, the bucket can be collapsed for easy storage and transport. Accordingly, the present disclosure makes specific reference thereto. Nonetheless, it is to be appreciated that aspects of the present invention are also equally applicable to other like applications, devices, and methods of manufacture.

BACKGROUND

By way of background, people should endeavor to take a shower regularly and preferably daily, to maintain personal hygiene and cleanliness. Some people especially those who work outdoors, may need to take a shower more than once a day. Being outdoors in dirt, dust and pollution is unhygienic and therefore, taking a shower becomes important to remove dirt and other material that the individual has encountered. This may be increasingly important if the individual has been exposed to fertilizer, insecticides, or the like, such as with agricultural applications, and the need to rinse the chemicals from their body is immediate. Taking a shower cleans the skin, washes away bacteria and other irritants and provides freshness. However, frequent travelers, campers, laborers, athletes, and others may be unable to shower for long periods of time while being on the road or engaged in a particular activity. Drivers such as truck drivers, locomotive engineers and the like, who have long driving or operating schedules and are generally away from home or convenient bathroom facilities for long periods of time may find it difficult to shower and maintain personal hygiene.

Most shippers and receivers do not allow truckers to use their restrooms as they are typically reserved for employees. In addition, locomotive operators or engineers, cannot stop a long train in order to use the shower facilities. Also, finding restrooms with shower facilities are tricky in some areas and trucking companies' terminals are not always easily accessible and generally, are far away from the destination the truck is making a delivery or a pickup. Truck stops offer shower rooms, but they can be expensive to use. Further, truck stop showers are usually busy, with many truckers waiting to shower. Truckers may wait for 30 minutes to an hour for a shower room which is frustrating. Paying money to a hotel or a motel for a shower is also expensive for truckers. Therefore, it is frustrating and time consuming for frequent travelers, operators, campers, and others to find a place to shower and bathe for maintaining personal hygiene and cleanliness.

Due to such problems faced by frequent travelers, campers, and others to take a shower while being on road or away from home, people desire a device or system in the form of a portable personal hygiene or cleaning system that allows them to easily take a shower or bathe virtually anywhere without paying any money or charges.

Therefore, there exists a long-felt need in the art for a portable shower or cleaning system that can be used by frequent travelers like truck drivers, campers, locomotive operators, and others for taking a shower while being on road or away from convenient bathroom locations. There is also a long-felt need in the art for a portable shower and cleansing system that can be carried by travelers in their vehicle or with them during travel or other outing. Additionally, there is a long-felt need in the art for a portable shower and personal hygiene system that functions like a conventional shower and allows users to stand or kneel to quickly bathe to maintain personal hygiene and cleanliness. Moreover, there is a long-felt need in the art for a portable shower or personal hygiene system that is collapsible and can be placed on ground or another stable surface for a quick bath or shower. Further, there is a long-felt need in the art for a portable shower system or personal hygiene that saves time of individuals in searching for showers or other areas where they can easily clean up after traveling. Furthermore, there is a long-felt need in the art for a portable shower or personal hygiene system that is cost effective, lightweight, and holds sufficient water for a shower. Finally, there is a long-felt need in the art for a portable shower or personal hygiene system that prevents people from having to stop and pay in specific areas or cities to take a shower or to otherwise avail themselves of a bathroom facility.

The subject matter disclosed and claimed herein, in one embodiment thereof, comprises a collapsible portable shower or personal hygiene system. The shower system or personal hygiene is in the form of a collapsible bucket. The bucket has a tapered top piece and a tapered bottom piece, and the top piece and the bottom piece are removably interlocked such that the top piece is positioned above the bottom piece. The top piece has a wide top rim and a narrow bottom surface. The bottom piece has a top surface with width equal to the narrow bottom surface of the top piece and a bottom surface which is narrower than the top surface of the bottom piece. The narrow bottom surface of the top piece has a protrusion along the periphery thereof. The top surface of the bottom piece has a groove along the periphery and the protrusion is interlocked to the groove to create the leakproof bucket. The user stands or kneels within the bucket to have a shower or a bath. The bucket has handles and hanging holes for easy carriage and storage.

In this manner, the collapsible portable shower or personal hygiene system of the present invention accomplishes all of the foregoing objectives and provides users with a modified cleaning basin designed to be used by frequent travelers, like truck drivers, and others that are not near a conventional bathroom or shower area for taking a shower. The shower or personal hygiene system is collapsible, does not leak and holds about four gallons of water. A user can stand or kneel within the shower system allowing a quick and effective bath without requiring the user to stop and find shower spaces in companies' terminals, truck stops, hotels, and motels.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The subject matter disclosed and claimed herein, in one embodiment thereof, comprises a collapsible portable shower or personal hygiene system. The shower or personal hygiene system further includes a collapsible bucket with the bucket having a top piece and a bottom piece. The top piece and the bottom piece are removably interlocked with one another. The top piece has a wide top rim and a narrow bottom surface with the bottom piece having a top surface with a width equal to the narrow bottom surface of the top piece and a bottom surface which is narrower than the top surface of the bottom piece. The narrow bottom surface of the top piece has a protrusion along the periphery thereof and the top surface of the bottom piece has a groove along the periphery thereof. The protrusion is interlocked to the groove to create the leakproof bucket for when a user stands or kneels within the bucket to have a shower or a bath.

In yet another embodiment, the top piece has a plurality of foldable panels configured for collapsing the top piece, and the bottom piece has a plurality of foldable panels configured for collapsing the bottom piece so that the top and bottom pieces form a generally flat configuration.

In yet another embodiment, a portable shower designed to be used by frequent travelers and others away from convenient bathing facilities is disclosed. The portable shower or personal hygiene system has a collapsible or telescoping structure with a collapsible top piece and a collapsible bottom piece. The top piece is positioned on top of the bottom piece and is interlocked to the bottom piece. Both the top piece and the bottom piece have a plurality of foldable panels for allowing the pieces to collapse. The top piece has a protrusion along the bottom surface thereof and the bottom piece has a groove along the top surface thereof. The protrusion is accommodated in the groove for interlocking the top piece and the bottom piece to form a leakproof shower or bathing unit. In use, an individual stands or kneels inside the shower or personal hygiene system for a bath or shower.

In yet another embodiment, the top piece has a pair of handles and a pair of hanging holes.

In yet another embodiment, the bottom piece has a drain hole configured to receive a hose for draining water.

In yet another embodiment, a method for getting a quick bathe in a portable shower or personal hygiene system is disclosed. The method includes the steps of providing a collapsible portable shower system. The system includes two collapsible interlocked components made of silicone and/or plastic. Next, moving the system from a first collapsed position to a second fully extended position and then placing water in the shower system. Next, an individual stands or kneels inside the shower for a quick bathe. After conclusion of the shower or cleaning ritual, then draining the water from the shower. Finally, collapsing the shower system from the second position to the first position for easy storage and transport.

In yet another embodiment, a method of collapsing and expanding a collapsible shower or personal hygiene system is described. The shower or personal hygiene system is in the form of a bucket or base receptacle and the method includes the steps of pressing one side down of the top rim of the bucket or base receptacle, and then almost substantially simultaneously pressing the other side down of the top rim of the bucket or base receptacle for extending the system from a first closed position and pulling one side up and then, the other side up to expand the system to a second extended position.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
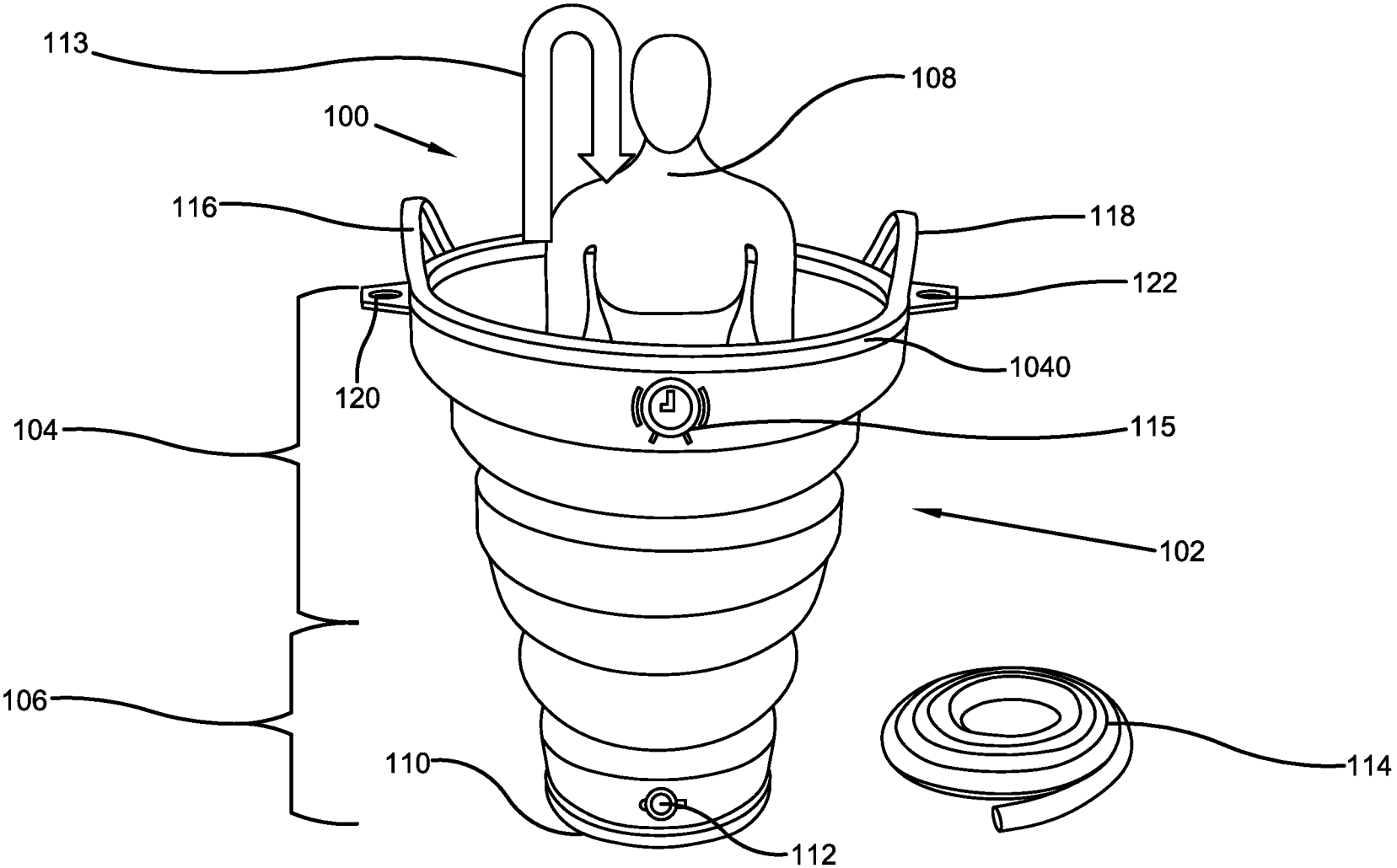
FIG. 1 illustrates a perspective view of one potential embodiment of the collapsible or telescoping shower or personal hygiene system of the present invention being used by an individual for bathing in accordance with the disclosed specification.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a portable shower or personal hygiene system that can be used by frequent travelers like truck drivers, and others where conventional bathroom facilities are not conveniently available for taking a shower or bath while being on road or away from home. There is also a long-felt need in the art for a portable shower or personal hygiene system that can be carried by travelers, campers, laborers in their vehicle during travel or in their gear. Additionally, there is a long-felt need in the art for a portable shower and cleaning system that functions like a conventional shower and allows users to stand or kneel to quickly bathe to maintain personal hygiene. Moreover, there is a long-felt need in the art for a portable shower system that is collapsible and can be placed on ground or another flat surface for a quick bath. Further, there is a long-felt need in the art for a portable shower or personal hygiene system that saves the time of travelers and other potential users in searching for showers or other areas quickly clean themselves off. Furthermore, there is a long-felt need in the art for a portable shower system that is cost effective, lightweight, and holds water for a shower or other bathing purposes. Finally, there is a long-felt need in the art for a portable shower system that prevents people from having to stop and pay to take a shower at public facilities.

The present invention, in one exemplary embodiment, is a portable shower designed to be used by frequent travelers, campers, laborers, and other individuals where convenient bathroom facilities are not available. The portable shower or personal hygiene system has a collapsible or telescoping structure that includes a collapsible top piece and a collapsible bottom piece. The top piece is positioned on top or over of the bottom piece and is interlocked to the bottom piece to form a relatively watertight seal. Both the top piece and the bottom piece have a plurality of foldable or telescoping panels for allowing the pieces to collapse on to one another. The top piece has a protrusion along bottom surface thereof and the bottom piece has a groove along top surface thereof. The protrusion is accommodated in the groove for interlocking the top piece and the bottom piece to form a leakproof cleaning unit, enabling an individual to stand or kneel inside the shower.

Figure 2:
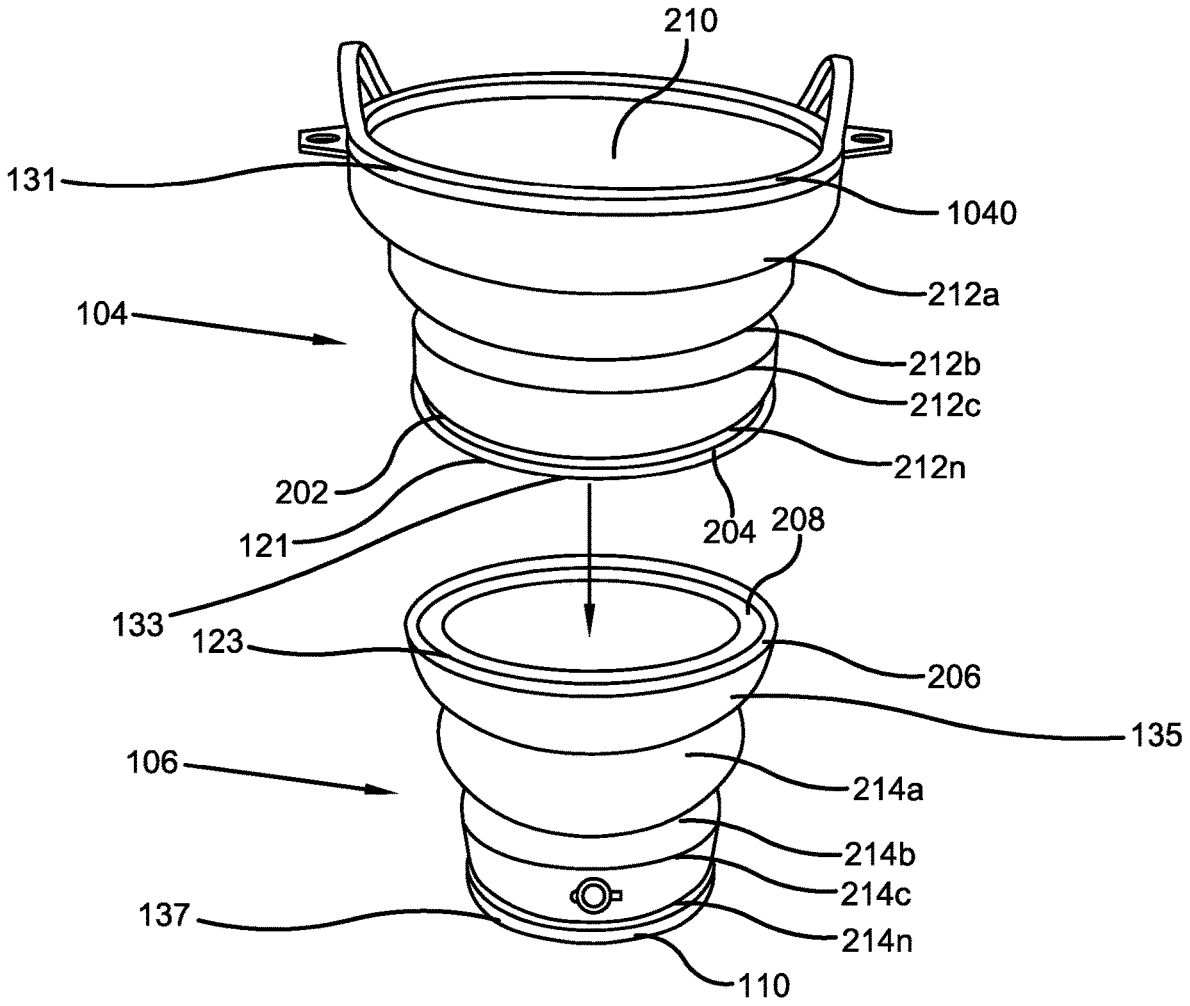
FIG. 2 illustrates a perspective view of one potential embodiment of the collapsible shower or personal hygiene system of the present invention with the two pieces detached from each other in accordance with the disclosed specification.

Referring initially to the drawings, FIG. 1 illustrates a perspective view of one potential embodiment of the collapsible shower or personal hygiene system of the present invention being used by an individual for bathing in accordance with the disclosed specification. The shower or personal hygiene system 100 of the present invention is portable, lightweight, and collapsible allowing people, such as frequent travelers, campers, laborers and others, who are not conveniently located near a bathroom or shower facilities to use the system 100 for a quick shower while being on the road or away from home. More specifically, the shower system 100 is in the form of a telescoping or collapsible bucket 102 having two collapsible pieces, a top piece 104 and a bottom piece 106, which are configured to removably interlock to form the system 100 as illustrated in FIG. 2. Each of the top and bottom pieces or portions of the system are depicted in the drawings a being generally round, but they may be of any suitable geometric shape such as oval, elliptical, square, triangular, rectangular or any other shape which may accommodate an individual standing or kneeling in the system. For example, a rectangular, oval, or elliptical shape may allow for more space when an individual is kneeling within the system.

Figure 3:
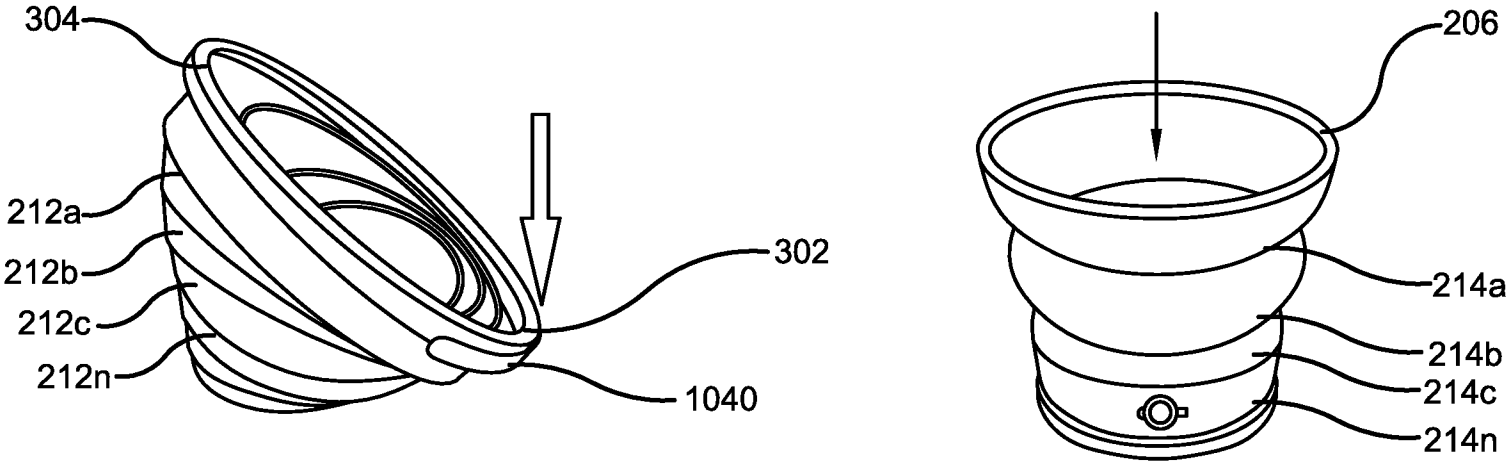
FIG. 3 illustrates a perspective view of one potential embodiment of the collapsible shower or personal hygiene system of the present invention being collapsed in accordance with the disclosed specification.

An individual 108 may stand or kneel inside the shower system 100 to quickly bathe when the top piece 104 and the bottom piece 106 are interlocked to form a relatively watertight seal. The shower or bathing basin 100 has a height from about 2' to about 6' with about 3' to 5' being preferred to meet requirements of different users. Both the top piece 104 and the bottom piece 106 are made from silicone and plastic and are designed to extend and collapse as illustrated in FIG. 3. The top piece and bottom piece, or first and second sections, may have an equal height or one of the first and second sections may have a greater height than the other. The bottom surface 110 of the bottom piece 106 can be made from a hard material such as a non-slippery plastic allowing the user 108 to take a shower or bathe in a secure manner without any slippage. The bottom piece 106 has a base or bottom surface 110 which may also be provided with non-slip strips or other patterns 111 (see FIG. 4).

The bottom piece 106 also has a drain hole 112 to which a hose pipe 114 can be removably attached to drain water stored in the system 100 after a bath or shower. The drain hole 112 is generally covered by a cover to prevent any unwanted draining of water. The cover may be a snap on or threaded cover. In the preferred embodiment, the shower bucket 100 is configured to hold between about two and eight gallons with about four to five gallons of water being preferred to allow for effective cleaning of the user 108. The top piece 104 and the bottom piece 106 can be detached from each other and can be collapsed separately allowing easy storage and transport.

Figure 5:
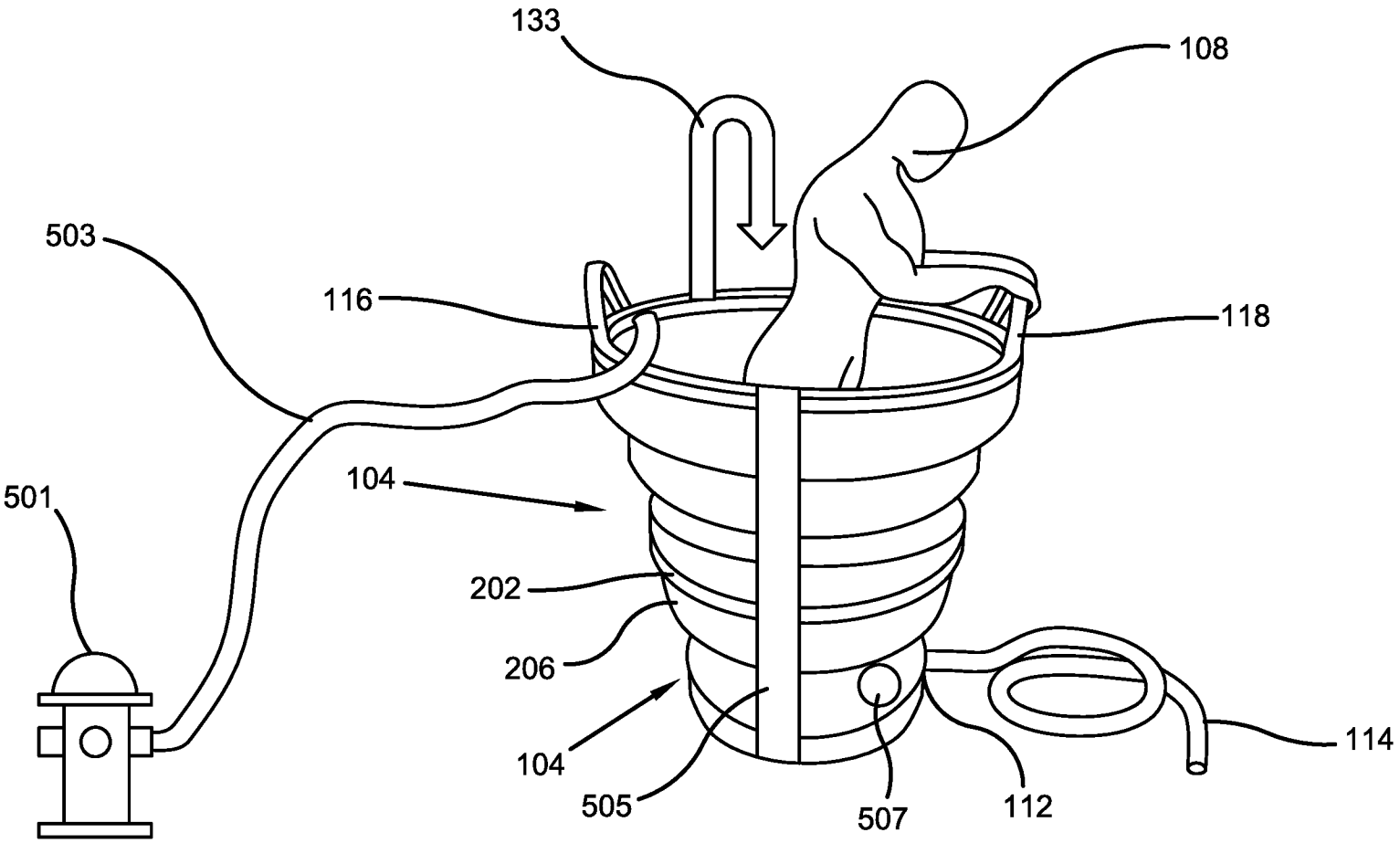
FIG. 5 is a perspective view of an individual standing inside one potential embodiment of the shower or personal hygiene system of the present invention to bathe in accordance with the disclosed specification.

The shower or personal hygiene system 100 is non-toxic, odorless, and durable and can be easily collapsed repeatedly. Further, the system 100 comes in different colors and is ideal for camping and trekking as well. The system may also find use with certain religious rituals where it is necessary to cleanse themselves after going to the bathroom. The rim 1040 of the top piece 104 has a pair of diametrically opposite handles 116, 118 for the user 108 to hold for stability as illustrated in FIG. 5. The top piece 104 also has a pair of hanging holes 120, 122 allowing the top piece 104 to be hanged on any hook. The top piece 104 may also include a shower head 113 that is removable mounted to the top piece 104. The hose 114 may be connected directly to the shower head 113 so that the system 100 can function as a more traditional shower. In this embodiment, the drain plug can be left open so that water can continue to drain from the base as the hose is continually run. The system 100 may also have a clock or alarm 115 so that the individual knows how long the system has been in use.

FIG. 2 illustrates a perspective view of the collapsible shower or personal hygiene system of the present invention with the two pieces detached from each other in accordance with the disclosed specification. As described earlier, the top piece 104 and the bottom piece 106 are removably interlocked to each other to form the shower system 100. Each of the top piece and bottom piece may have a gasket or other seal 121, 123 to aid in making a watertight or nearly watertight seal. The gaskets may be a neoprene rubber which is readily deformable. More specifically, the top piece 104 is wider or has a greater diameter along the upper edge 131 and longer in length than the bottom piece 106 and preferably, the top piece 104 is about 1.5 times the length of the bottom piece 106. The bottom edge 133 of the top piece 104 is approximately the same diameter as the upper edge 135 of the bottom piece 106 and the lower edge 137 of the bottom piece 106 has a smaller diameter than the top edge of the bottom piece 106. The top piece 104 has a wider top rim 1040, and the narrower bottom surface 202 has at least one protrusion 204 extending vertically from the periphery of the bottom surface 202.

For allowing interlocking of the bottom edge 133 of the top piece 104 and the top edge 135 of the bottom piece 106 to form the shower system 100 without any leakage, the bottom surface 202 of the top piece 104 and the top rim 206 of the bottom piece 106 are equally dimensioned and are provided with a deformable seal 121 and 123. The top rim 206 has a groove 208 around the periphery such that the protrusion 204 of the top piece 104 is received by the groove 208 and is locked into the groove 208. The groove 208 and the protrusion 204 form a leakproof, interlocking mechanism for forming the shower or personal hygiene system 100.

It should be noted that the top piece 104 forms a continuous opening 210 from the top rim 1040 to the bottom surface 202. The bottom piece has the open top rim 206 but the bottom base surface 110 is made of plastic or rubber. For forming the shower system 100, the top piece 104 and the bottom piece 106 are interlocked and when the system 100 is not in use, the pieces 104, 106 can be detached and collapsed for easy storage.

Figure 4:
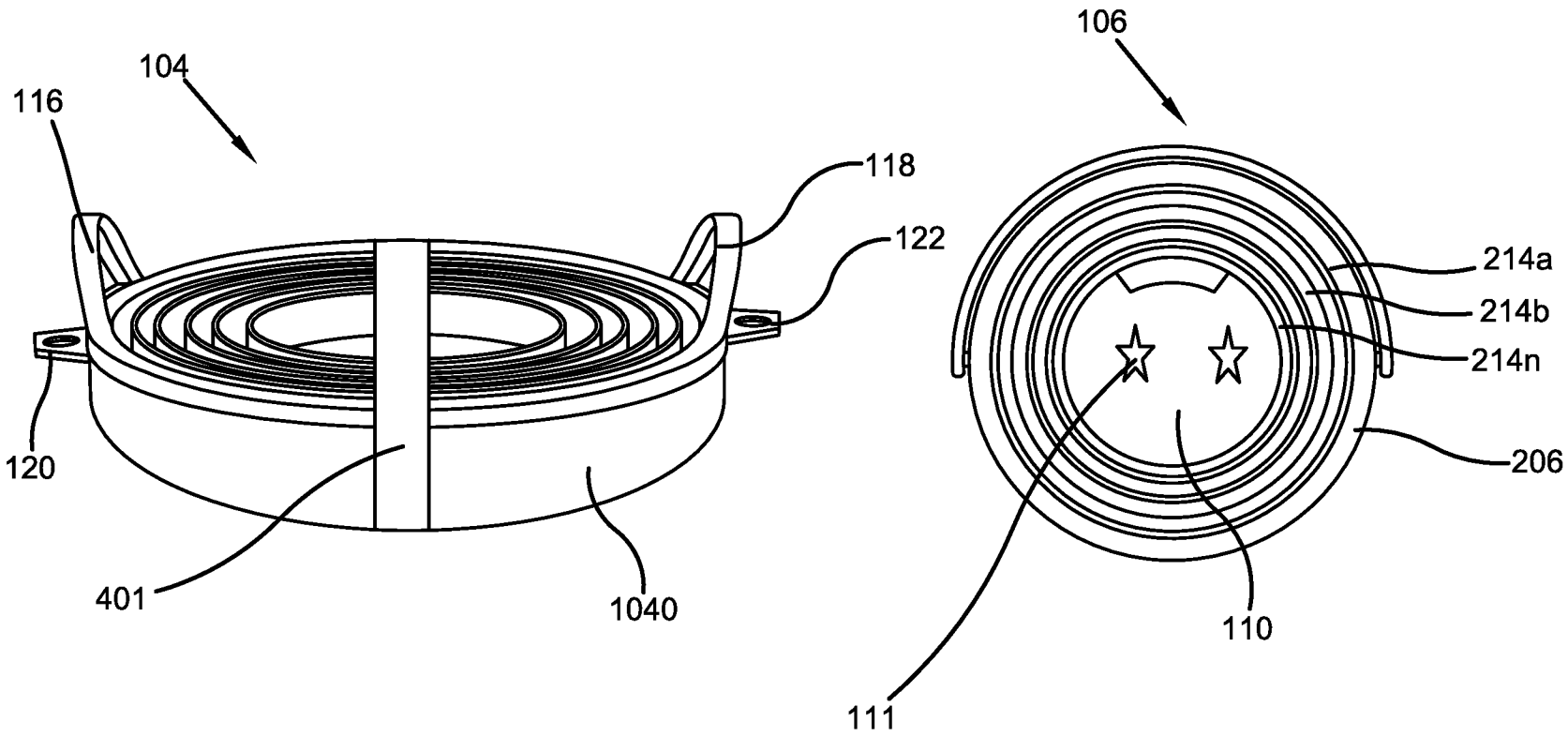
FIG. 4 is a perspective view of one potential embodiment of the collapsible shower or personal hygiene system of the present invention, wherein the top and bottom pieces are collapsed for easy storage in accordance with the disclosed specification.

The top piece 104 has a plurality of equidistant foldable horizontal panels 212*a-n* that are positioned along the surface of the top piece 104 and help in nesting or otherwise collapsing the top piece 104 as illustrated in FIGS. 3 and 4. The panels are flexible, nestable and collapse when the panels are pushed from the top as illustrated in FIG. 3 from a first position to a second position, e.g., extended or collapsed. Similarly, the bottom piece 106 has a plurality of equidistant foldable and nestable panels 214*a-n* that help in collapsing the bottom piece 106 from a first position to a second position, e.g., extended or collapsed.

FIG. 3 illustrates a perspective view of the collapsible or nestable personal hygiene system of the present invention being collapsed in accordance with the disclosed specification. The portable personal hygiene system 100 is configured to be collapsed or nested on itself to allow for easy storage and transport in a vehicle or other gear such as a truck, luggage, backpack, or the like. The system 100 occupies less space and is lightweight. The top piece 104 and the bottom piece 106 can be separately collapsed or nested and the portable personal hygiene system 100 can be collapsed when the pieces 104, 106 are interlocked.

As illustrated, one end 302 of the top rim 1040 of the top piece 104 is pressed allowing the foldable panels 212*a-n* of the top piece 104 to collapse or nest on themselves, and then, the opposite end 304 is pressed to completely collapse or nest the top piece 104. Similarly, the bottom piece 106 can be collapsed by pressing the top rim 206 to collapse the folding lines 214*a-n*.

FIG. 4 illustrates a perspective view of the collapsed or nested top piece 104 and the bottom piece 106 for easy storage in accordance with the disclosed specification. The top piece 104 and the bottom piece 106 are collapsed as described in FIG. 3 by pressing the top rim of the respective pieces 104, 106 in a downward direction. In preferred embodiment, the height of the collapsed top piece 104 ranges from about 2" to about 6" with about 2" to about 4" being preferred, which is the width of the top rim 1040. When the top piece 104 is collapsed, the foldable lines 212*a-n* are accommodated inside the top rim 1040 such that the handles 116, 118 and the hanging holes 120, 122 are accessible for holding and hanging the top piece 104. A strap 401 may be provided to hold the system 100 in its fully collapsed position and to provide an additional carrying assist.

When the bottom piece 106 is collapsed, the top rim 206 accommodates the bottom piece 106, such that all the foldable lines 214*a-n* are placed on the bottom surface 110 and inside the top rim 206 and forming a fully nesting configuration.

FIG. 5 illustrates a perspective view of an individual standing inside the shower system 100 taking a bath or shower in accordance with the disclosed specification. The individual 108 can stand inside the shower system 100 for taking a bath or shower and the bucket can hold about two and eight gallons of water with about four to five gallons of water being preferred allowing the user 108 to quickly bathe without requiring any permanent shower space. Once the user completes the shower, the water is drained from the hose pipe 114 connected to the drain hole 112. The user 108 can collapse the shower basin 100 by pressing the top rim 1040 or one of the handles while staying inside the system 102 or can collapse after detaching the top piece 104 and the bottom piece 106 as described earlier in the disclosure. The system may further include a rigid support or brace 505 that can engage the top rim of the top portion to prevent the system from collapsing while the individual is engaged in cleaning themselves. The brace 505 may itself be telescoping so that it reduces to a small size for easy transport. Where available, a hose 503 may be connected to a water source such as a faucet or hydrant 501 to allow a user to take a shower using a shower head 113. Alternatively, a small battery-operated pump 507 may be placed in the base of the system 100 and pump the water up to the shower head 113.

Figure 6:
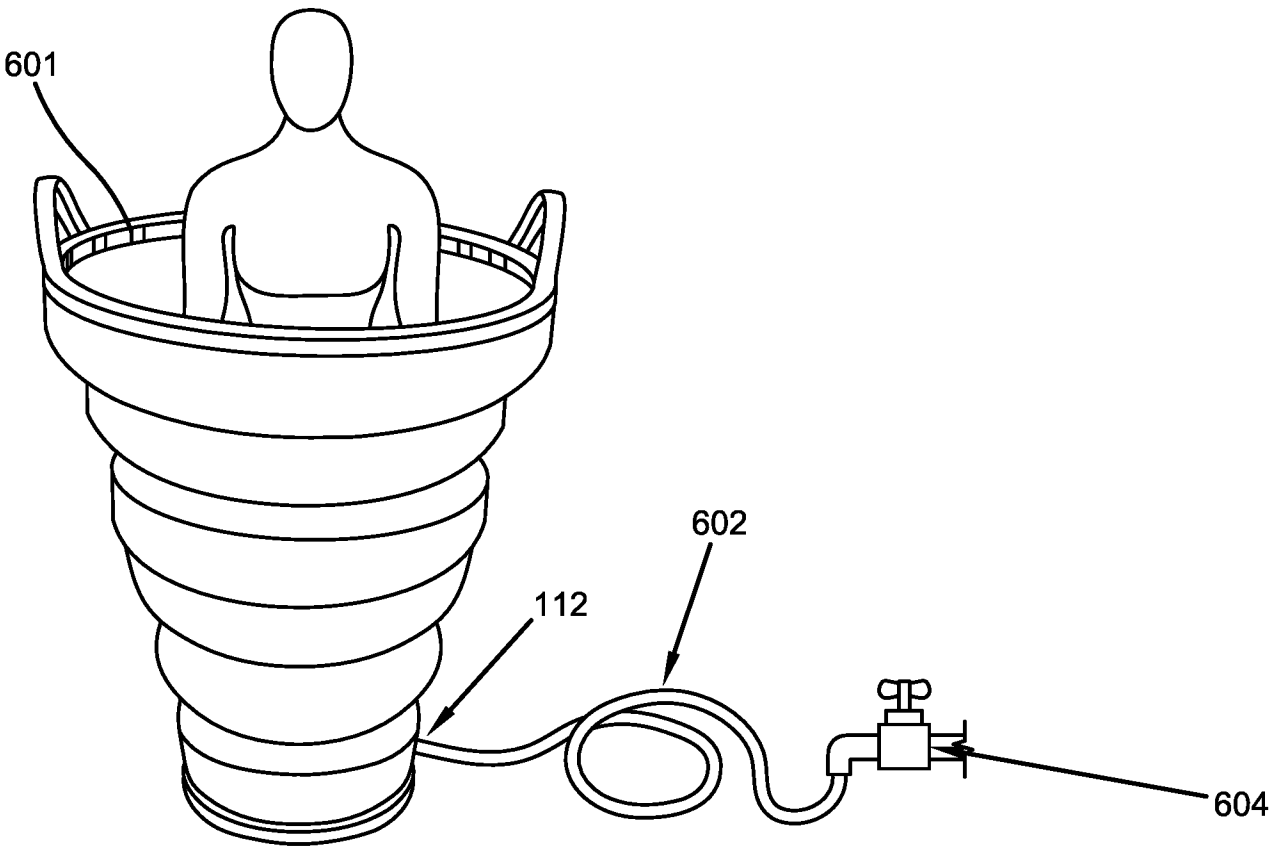
FIG. 6 illustrates a perspective view of one potential embodiment of the shower or personal hygiene system of the present invention being filled with water using a hose connected to a tap in accordance with the disclosed specification.

FIG. 6 illustrates a perspective view showing the shower system being filled with water using a hose connected to a tap or other water source in accordance with the disclosed specification. In the present embodiment, the drain hole 112 receives a different hose 602 which is connected to a tap 604. Water runs from the tap 604 to the shower system 100 through the hose 602 and fills water in the system 100 for bathing, if a pump is provided, as in connection with FIG. 5, the pump can pump the water up to a shower head or alternatively, the water can be dispersed through a number of openings 601 in the upper rim of the top portion. The openings may vary in size from 0.25" to 0.50".

It should be appreciated that the shower system 100 can be easily carried in a vehicle, in luggage or other gear by people and can be extended, nested, and collapsed easily. The system holds up to about two and eight gallons of water with about four to five gallons of water being preferred and therefore, provides an effective cleaning or bathing experience while being on the road. The shower system 100 is not only cost-effective but saves a lot of time of people for maintaining personal hygiene and cleanliness. The system can be easily stored and transported in the collapsed or nested form without occupying much space.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "shower system", "shower basin", "collapsible shower or personal hygiene system", "portable collapsible cleaning system", and "shower system" are interchangeable and refer to the portable and collapsible shower or personal hygiene system 100 of the present invention.

Notwithstanding the foregoing, the portable, nestable and collapsible system 100 of the present invention can be of any suitable size and configuration as is known in the art without affecting the overall concept of the invention, provided that it accomplishes the above-stated objectives. One of ordinary skill in the art will appreciate that portable and collapsible shower system 100 as shown in the FIGS. are for illustrative purposes only, and that many other sizes and shapes of the portable and collapsible shower system 100 are well within the scope of the present disclosure. Although the dimensions of the portable and collapsible shower system 100 are important design parameters for user convenience, the portable and collapsible shower system 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A collapsible cleaning system comprising:

a top piece having a first shape and a first upper rim with a first diameter; and a bottom piece having a second shape and a second upper rim with a second diameter, wherein second diameter is smaller than the first diameter, and further wherein each of the top and bottom pieces are repositionable from a first extended position to a second collapsed position such that the bottom piece is nestable within the top piece.

2. The collapsible cleaning system as recited in claim 1, wherein the top piece is detachable from the bottom piece.

3. The collapsible cleaning system as recited in claim 1, wherein the top piece comprises a protrusion along a lower rim and the bottom piece comprises a groove along the upper rim.

4. The collapsible cleaning system as recited in claim 3, wherein the protrusion fits within the groove to form a watertight seal.

5. The collapsible cleaning system as recited in claim 4, wherein the watertight seal further comprises a deformable material.

6. The collapsible cleaning system as recited in claim 5, wherein the deformable material is a neoprene rubber.

7. The collapsible cleaning system as recited in claim 1, wherein each of the top piece and the bottom piece are comprised of a plastic or a rubber.

8. The collapsible cleaning system as recited in claim 1, wherein the bottom piece comprises a bottom surface at a base of the bottom piece to form a bucket enclosure.

9. The collapsible cleaning system as recited in claim 1, wherein the bottom piece further comprises a drain to allow water to be drained from an interior of the bottom piece.

10. The collapsible cleaning system as recited in claim 1, wherein the top and bottom pieces, when together and in the extended position, range in height from two feet to six feet.

11. The collapsible cleaning system as recited in claim 1, wherein the top piece further comprises a removable shower head.

12. The collapsible cleaning system as recited in claim 11, wherein the removable shower head is in fluid communication with a hose.

13. A nestable personal hygiene system comprising:

a first portion; and a second portion comprised of a bottom surface and a drain positioned near the bottom surface to allow water to be drained from an interior of the second portion;

wherein the first portion has a larger diameter than the second portion, and the second portion forms a base of the nestable personal hygiene system;

wherein each of the first and second portions is comprised of a plurality of foldable panels with each successive panel of the plurality of panels nesting within the next panel; and further wherein the second portion is fully nestable within the first portion.

14. The nestable personal hygiene system of claim 13, wherein each of the first and second portion is comprised of a plastic or a rubber.

15. The nestable personal hygiene system of claim 13, wherein the interior of the second portion holds between two and eight gallons of water.

16. The nestable personal hygiene system of claim 13, wherein the first and second portions are detachable from one another and the first and second portions comprise an interlocking groove and a protrusion to form a watertight seal.

17. The nestable personal hygiene system of claim 16, wherein the watertight seal is further comprised of a deformable material.

18. The nestable personal hygiene system of claim 13, wherein each of the first and second portions is repositionable between an extended position and a collapsed position and, when combined and in the extended position, have a length of between two feet and six feet.

19. The nestable personal hygiene system of claim 13 further comprising an external, telescoping brace and a shower head.

20. A portable shower system comprising:

a top piece having a diameter at an upper rim;

a bottom piece comprised of a bottom surface at a first end and a diameter at an upper rim, wherein the diameter of the upper rim of the top piece is greater than the diameter of the upper rim of the bottom piece; and a drain disposed near the bottom surface to allow water to drain from the bottom piece, wherein the bottom piece has a capacity to hold between two and eight gallons of water;

wherein the top piece fits on top of the bottom piece and the top and bottom pieces are held together by a protrusion in the top piece and a groove in the bottom piece such that the protrusion and the groove form a watertight seal;

wherein the top piece and the bottom piece are repositionable between a collapsed position and an extended position and have a combined height between two feet and six feet when both the top piece and the bottom piece are in the extended position;

wherein each of the top and bottom pieces is comprised of a plurality of foldable panels; and further wherein, the bottom piece is fully nestable within the top piece.

* * * * *